US005709604A

United States Patent [19]

Coats et al.

[11] Patent Number: 5,709,604

[45] Date of Patent: Jan. 20, 1998

[54] RING-SWING SKILL GAME

[76] Inventors: David K. Coats, 220 E. Flamingo, Las Vegas, Nev. 89109; Marvin Richey, 745 Yacht Harbor, Las Vegas, Nev. 89128

[21] Appl. No.: 585,495

[22] Filed: Jan. 16, 1996

[51] Int. Cl.[6] ..... A63B 67/06; A63B 67/10

[52] U.S. Cl. ..... 463/23; 463/31; 463/57; 273/332; 273/336; 273/367; 273/371

[58] Field of Search ..... 463/1, 7, 23, 30, 463/31, 35, 53, 57; 273/317, 317.1, 329, 331, 332, 336, 343, 364, 367, 368, 369, 371, 373, 374, 375, 378, 381, 386, 399, 406, 441; 340/323 R; 364/410, 411

[56] References Cited

U.S. PATENT DOCUMENTS

| | | | |
|---|---|---|---|
| 292,899 | 2/1884 | Davies | 273/332 |
| 1,052,907 | 2/1913 | Fergusson | 273/332 |
| 1,517,454 | 12/1924 | Platt | 273/332 |
| 1,578,142 | 3/1926 | Laskowski | 273/332 |
| 2,095,390 | 10/1937 | Lange et al. | 273/332 |
| 2,147,176 | 2/1939 | Ronzone | 273/332 |
| 2,942,886 | 6/1960 | Ackerman | 273/332 |
| 2,950,917 | 8/1960 | Lyon | 273/332 |
| 3,024,025 | 3/1962 | Richardson et al. . | |
| 4,120,498 | 10/1978 | Mutschler et al. | 273/332 |
| 4,635,942 | 1/1987 | Flaherty, Jr. | 273/332 |

*Primary Examiner*—Jessica Harrison
*Assistant Examiner*—Mark A. Sager
*Attorney, Agent, or Firm*—Philip D. Junkins

[57] ABSTRACT

The present invention relates to a ring-swing skill game for play by one or more players. The basic structure of the game apparatus includes an upright game console, a target hook projecting from the front side of the console, a boom projecting from the upper portion of the console, an elongated flexible tether cord suspended from the outer end of the boom, and a ring affixed to the lower free end of the tether cord for swinging movement toward the game console by the one or more players during game play to attain hooking engagement of the ring with the hook. An electrically powered programmable computer board including game scoring circuitry is electrically interconnected to the ring and hook for detecting and recording ring contact with, and ring catches by, the hook as scoring events. A hook rotation mechanism is interconnected and controlled by the computer circuitry for rotating the hook from a pre-game non-play position with the hook opening in a fixed vertical downward orientation to and through other game play positions and motions to establish a number of game play skill levels. Electronic game score displays are interconnected to the computer board for indicating numeric score values to the players during game play.

19 Claims, 5 Drawing Sheets

RING-SWING SKILL GAME

BACKGROUND OF THE INVENTION

1. Field of the Invention

The present invention relates to amusement and skill game machines. More particularly, the invention relates to game machines which utilize electronic programmable circuitry for activating, recording and displaying the scoring during play of the game by one or more players.

2. Description of the Prior Art

Game machines are generally operated in response to the insertion of coins, tokens or other disks (all hereinafter referred to as coins) into one or more coin inlets located on the body or face panel of such machines. Over the past ten to fifteen years the most popular indoor electronic scoring skill games have included games such as miniaturized table-top bowling and darts. In electronic bowling games a metal puck is substituted for the classic bowling ball and a set of 10 pins are hung downwardly from a scoring rack for impact by the puck. In electronic dart games the thrown projectiles either have a magnetized blunted forward end which are somewhat unreliable in sticking to the target dart board, or the projectiles have an unblunted forward end which is captured by and held between a multiplicity of small semi-flexible fingers projecting from the face of the target dart board. More recently a miniaturized indoor electronic scoring horseshoe pitching game has been developed to simulate the original outdoor game with such game apparatus embodied in U.S. Pat. No. 4,789,163 granted in 1988 to L. W. Warner et al.

The foregoing electronic scoring skill games are frequently placed and operated in bar rooms and taverns and are normally played by adults individually or as competitive teams. Other electronic skill games have been located and played in an arcade environment by younger persons. Electronic scoring arcade games have for many years consisted of a wide variety of pin-ball machines. Note recently, sophisticated and complex game apparatus has been introduced to the arcade scene which comprise games played by directing a roll-down playing piece (usually a ball) towards either a stationary or moving target with individual player scoring, multiple player scoring and progress bonus scoring indicated via scoring indicia. One such electronic scoring roll-down arcade game has been described in U.S. Pat. No. 5,409,225 granted in 1995 to B. M. Kelly et al.

Another form of skill game has involved the seemingly simple game task of tossing a ring from a distant point over a post or onto a hook. An advanced form of such a game task, in the form of a toy, has involved the combining of the toss-ring with an elongated flexible member or tether cord with the ring thereby adapted to be engaged upon a hook when the flexible member is swung forwardly from a distant point by a player. In early U.S. Pat. No. 1,052,907 granted to H. A. Fergusson, the inventor has provided an elongated flexible ring-carrying member in which the flexible member and attached ring form part of an electric circuit which includes a bell whereby when the circuit is closed by the ring engaging upon the hook the bell rings indicating a player score. In later U.S. Pat. No. 1,578,142 granted to F. J. Laskowski, ring-swing game apparatus is described in which a cord-suspended ring is swung in an attempt to engage a distant hook-like element. After being successfully swung and hooked, the ring is released from the hook-like element by mechanical linkage means which simultaneously activates a register for indicating that the player has scored a game point.

The prior art patents do not disclose coin-operated ring-swing games and known ring-swing game machines are not coin-operated and do not utilize electronic programmable circuitry for activating, recording and displaying the scoring during play of the games by one or more players.

It is an object of the present invention to provide a coin-operated, electronically programmed ring-swing skill game playable by one or more players.

It is a further object of the invention to provide a ring-swing skill game which incorporates electronic programmable circuitry for activating, recording and displaying the game scoring during play of the game by one or more players.

It is still a further object of the invention to provide a coin-operated indoor skill game in which a ring, affixed to a tethering cord, is swung by a player in attempts to achieve contact and hooking engagement with a game hook and thereby player and game scoring.

It is another object of the invention to provide an electronic programmable ring-swing game having selectable levels ring-hooking skill.

Other objects and advantages of the invention will be apparent from the following summary and detailed descriptions of the invention, taken together with the accompanying drawing figures.

SUMMARY OF THE INVENTION

The present invention relates to novel coin-operated indoor ring-swing skill game apparatus which utilizes electronic programmable circuitry for activating game play, and for recording and displaying player and game scoring during play of the game by one or more players. Further, the game apparatus provides skill level adjustment whereby players may increase or decrease the difficulty of achieving ring hooks and thus the difficulty level for scoring game points during game play.

The game apparatus and operating mechanisms and its electronic circuitry components are housed in a vertical console or cabinet. Mounted at (and extending through) the upper portion of the front wall of the console is a tubular ring-swing pole or boom which projects outwardly and forwardly from the wall. At the extended outer end of the boom there is attached a flexible tethering cord which bears at its free end the metallic swing ring of the game. The boom, tethering cord and swing ring are electrically conductive and form interconnected external components of the low voltage game scoring circuitry of the game apparatus.

Mounted at (and extending through) the intermediate portion of the front wall of the game console is a projecting ring hook. During game play, the swing ring (at the free end of the tethering cord) is projected or swung alternatively by the ring-swing game players toward the game console and its projecting ring hook to obtain a point-scoring hook-touch or a higher point-scoring hook-catch in accordance with game play.

The ring hook has associated therewith a hook rotation mechanism located within the console which is programmed to provide a selection of game skill levels to the game players. Thus, at a first and lowest skill level the game hook remains stationary with the hook opening at a vertical upward ring catch position. At a second and intermediate skill level the hook rotation mechanism alternates the hook (and its hook opening) left and right to about 90 degrees of its vertical upward ring catch position. Finally, at a third and highest selected game skill level the hook rotation mechanism continuously rotates the hook (and its hook opening) over 360 degrees during the periods within which the player or players attempt to attain ring hooks. It should be understood that other game skill levels may be programed within the game circuitry. During periods when the ring-swing skill game of the invention is idle, i.e., not operating in response to coin activation of the game circuitry, the hook rotation mechanism positions the hook in a stationary position with its hook opening facing downwardly whereby ring hooking is precluded.

The electronic circuitry of the coin-operated indoor ring-swing skill game of the invention is described in detail hereinafter. In brief, however, such circuitry (upon reception of game initiation coins) includes means for: power on-off switching; circuit checks; false coin detection and rejection; receiving indication of single or two player modes of play; receiving indication of skill level selection; scoring detection and score display for each player; bonus scoring and score accumulation with appropriate point display; player sequence and play time measurement; and game termination.

BRIEF DESCRIPTION OF THE DRAWING FIGURES

The above and other objects and advantages of the present invention will become more apparent from the following detailed description of the invention when read in connection with the accompanying drawings, in which:

FIG. 1 is a side elevation view of the upright console for the ring-swing skill game of the present invention showing particularly swing locations of the ring and its tethering cord, the boom or beam from which the tethering cord depends at its outer end, and the location of the ring hook mechanism at the forward mid-section of the game console;

FIG. 2 a somewhat enlarged side view of the boom mounting bracket and inner boom portion within the upper section of the game console and showing via partial sectioning the means by which the extended outer boom portion is removably attached to the inner boom portion;

DETAILED DESCRIPTION OF THE PREFERRED EMBODIMENT OF THE INVENTION

Figures 1, 2:
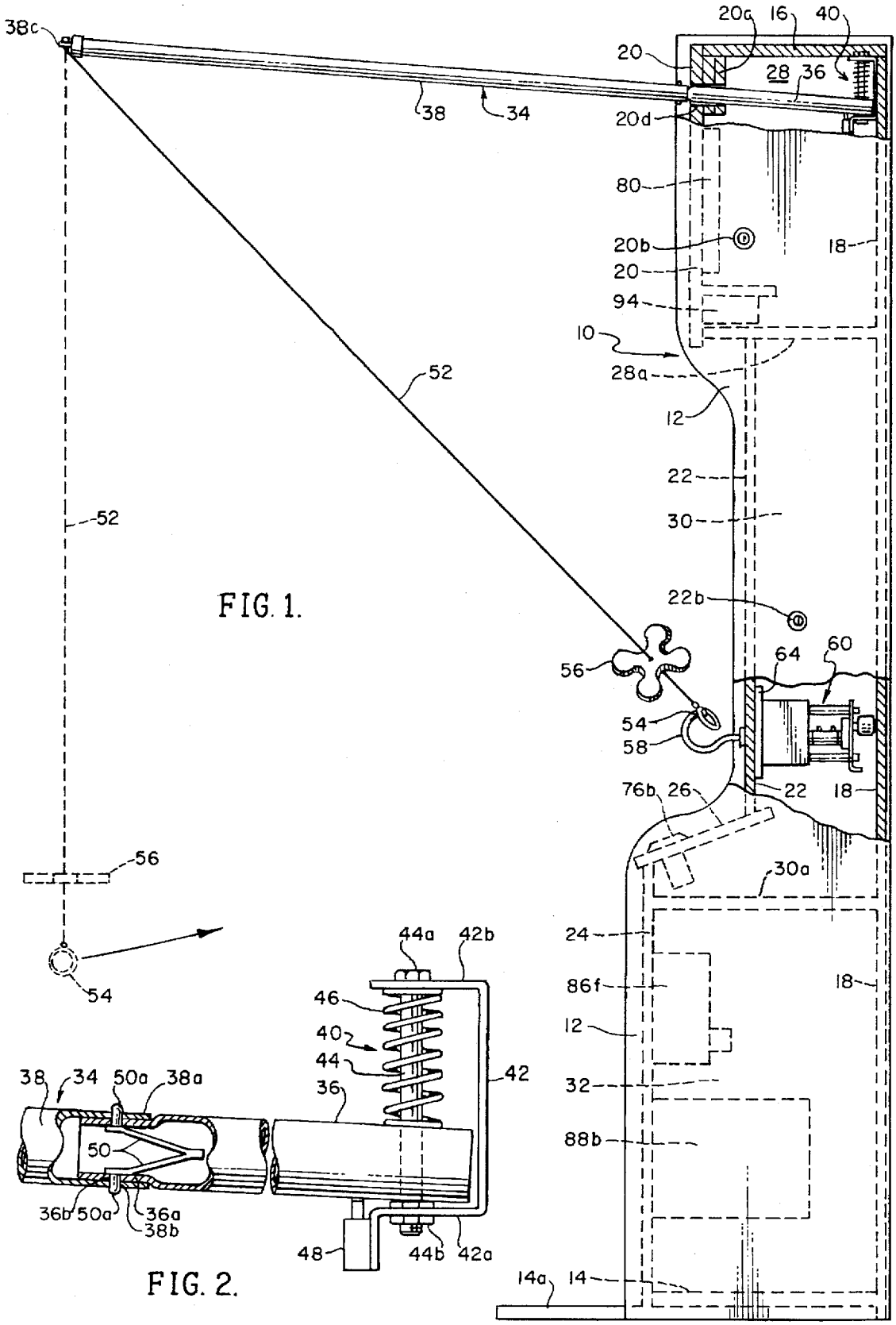
Figure 3:
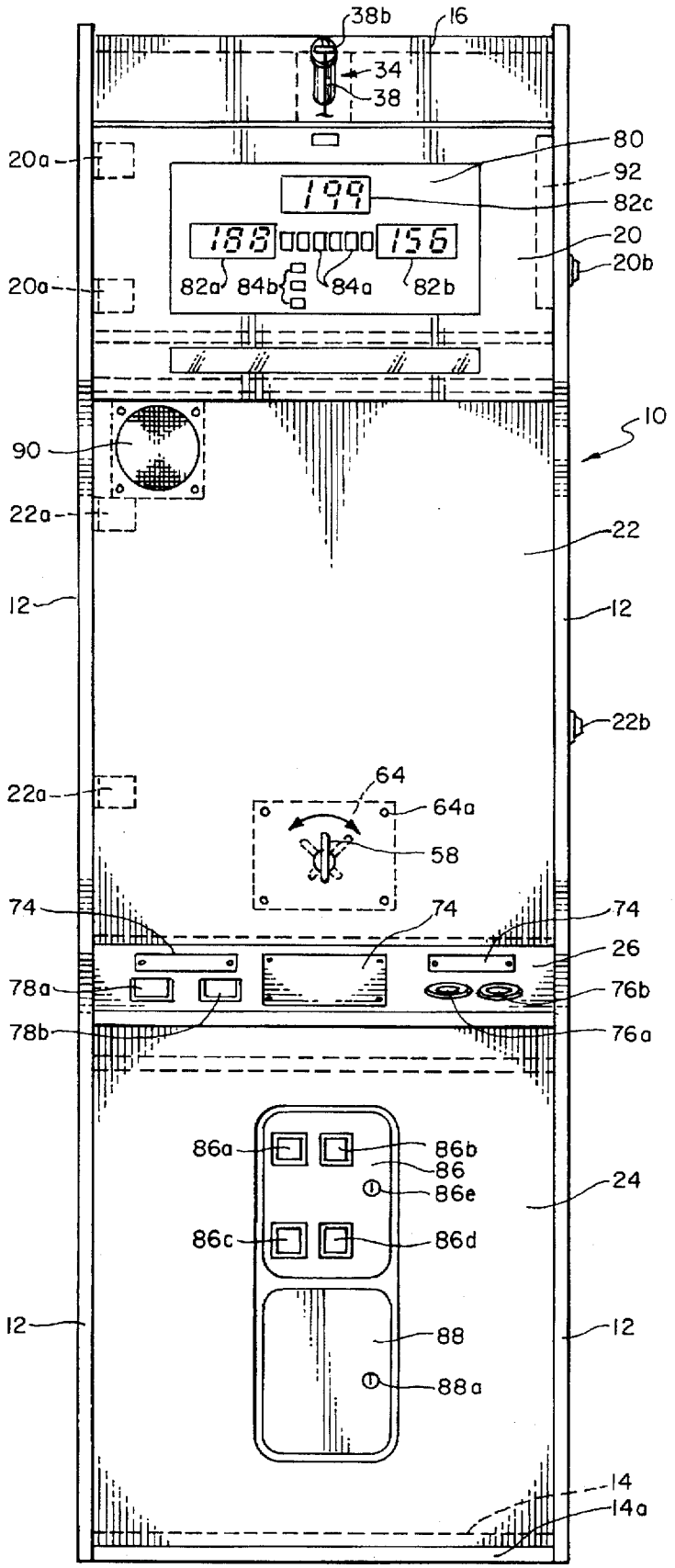
FIG. 3 is a front elevation view of the upright console of the ring-swing game showing particularly the upper score display panels, the central ring hook, lower game instruction escutcheon with player number and skill level selection buttons, and bottom coin reception and storage section.

Referring initially to FIGS. 1 and 3 of the drawings, there is illustrated side elevation and front elevation views of the novel coin-operated indoor ring-swing skill game of the present invention. The console or cabinet 10 of the game is comprised of elongated vertical side walls 12, a base wall 14 (including forwardly projecting console stabilizing tongue portion 14*a*) and top wall 16, a back wall 18, and upper, intermediate and lower vertical front wall segments 20, 22 and 24, respectively. Between and interconnecting the lower end of the intermediate front wall segment 22 and the upper end of the lower front wall segment 24 is a game escutcheon 26 upon which are mounted game instruction panels and game initiation and control elements as described hereinafter. The game console 10 is compartmented with an upper compartment 28 defined by and between top wall 16 and a lower horizontal wall 28*a*, with an intermediate compartment 30 defined by and between horizontal wall 28*a* and a bottom horizontal wall 30*a*, and with a lower compartment 32 defined by and between horizontal wall 30*a* and the base wall 14 of the console.

The upper vertical front wall segment 20 of console 10 includes hinges 20*a* at one side thereof and a keyed wall lock mechanism 20*b* to provide restricted access to upper compartment 28. The intermediate vertical front wall segment 22 of the console includes hinges 22*a* at one side thereof and a keyed wall lock mechanism 22*b* to provide restricted access to the intermediate compartment 30. Access to lower compartment 32 of the console is provided through doors mounted in the lower front wall segment 24 as described hereinafter.

Mounted at and through the central upper portion of upper front wall segment 20 of the game console or cabinet 10 is tubular ring-swing pole or boom 34 which extends outwardly and forwardly from the front wall segment 20 and rearwardly into the console for removable attachment to back wall 18. The ring-swing pole or boom 34 is of separable two-part construction with the inner boom section 36 extending from back wall 18 to and through front wall segment 20. The outer removable boom section 38 projects forwardly outside of console 10 from its point of coupling to boom section 36 to its extended end whereat a tethering cord for the swing ring of the game is attached as described hereinafter.

The rear (innermost) end of inner boom section 36 of boom 34 is attached to the back wall 18 of console 10 via a boom mounting device 40 which provides boom tampering detection and protection. The boom mounting device 40 is shown in greater detail in FIG. 2 and is comprised of: a bracket 42 for mounting the device to the back wall 18 of the console, a boom securing bolt 44, a boom deflection protection spring 46, and a pressure-sensitive switch 48 for detecting excessive flexing of the boom 34. The boom securing bolt 44 extends through the boom section 36 and between the lower leg 42*a* and upper leg 42*b* of bracket 42 and is maintained therebetween by bolt head 44*a* and bolt nut 44*b*. The deflection spring 46 surrounds the upper portion of bolt 44 and pressure biases the boom 34 downwardly at its inner terminal end. The boom 34 extends through a front opening 20*d* in the upper front wall 20 of the console and is slightly pivotal therein when a downward force is applied to the forward end of the boom by the tethering cord. When excessive downward force is experienced by the boom through such cord or by direct pull force on the boom, the rear end of the boom lifts from its downwardly biased position within bracket 42 and the pressure-sensitive switch 48 activates an alarm. The front wall 20 of console 10 is reinforced in the area of the front opening 20*d* by boom support blocks 20*c*.

As further shown in FIG. 2, the tubular ring-swing boom 34 is of two-part construction with the outer boom section 38 removably coupled to the inner boom section 36. Thus, the outer end portion 36*a* of tubular boom section 36 is of reduced diameter and the rear end portion 38*a* of the tubular boom section 38 is slip-fit over the reduced diameter end portion 36*a* of boom section 36. The inter-coupled boom sections 36 and 38 are maintained in their coupled relationship (as shown in FIG. 2) by a tube-lock leaf spring device 50 of known design with the tube lock hubs 50*a* of such device projecting through aligned lock ports 36*b* and 38*b*, respectively, in the end portions 36*a* and 38*a* of boom sections 36 and 38, respectively.

As previously indicated, the outward extended end of boom section 38 of the tubular ring-swing boom 34 has attached thereto a tethering cord for the swing ring of the game apparatus, Thus, boom section 38 bears at its outer end a tether cord attachment ring or hook 38*c* to which is affixed tether cord 52 of appropriate length. The tether cord includes at its free end the metallic game ring 54 which, during game play, is projected alternatively by the ring-swing game players toward the game console and its projecting ring hook 58 to obtain a scoring hook-touch or a higher scoring hook-catch in accordance with game play as described hereinafter. A spinner 56 may be associated with the tether cord 52 to provide an alternative means for swinging the ring. The ring-swing boom 34, tethering cord 52 and metallic swing ring 54 are electrically conductive and form interconnected external components of the low voltage game scoring circuitry of the game apparatus.

Figure 4:
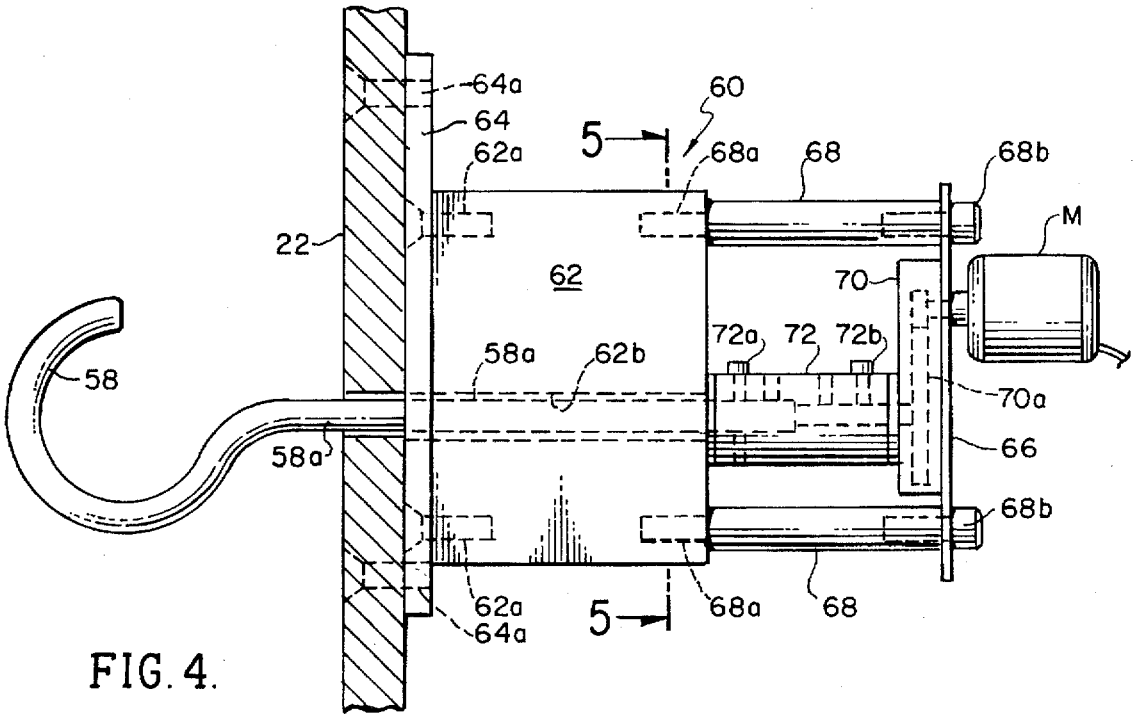
FIG. 4 is an enlarged side elevation view of the ring-swing game hook and the hook position and rotation control mechanism which is responsive to game initiation, skill level determination, and game termination.
Figure 5:
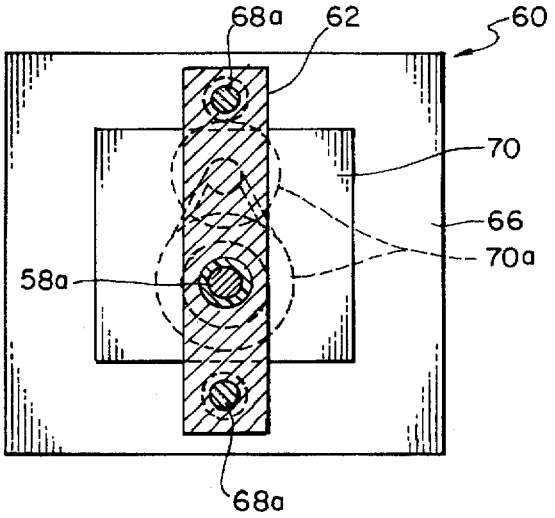
FIG. 5 is a sectional view of the hook position and rotation control mechanism shown in FIG. 4 taken on line 5—5 of FIG. 4.

The ring hook 58 has associated therewith a hook rotation mechanism 60 which is programmed (as described hereinafter) to provide a selection of game skills to the game players. Structural details of one possible hook rotation mechanism 60 are shown in FIGS. 4 and 5 wherein a central rectangular hook stem mount block 62 is affixed by screw fasteners 62*a* to a mount plate 64 which in turn is mounted by screw fasteners 64*a* to the inside of the central hinged wall 22 of the console 10. The hook stem 58*a* projects through wall 22 and plate 64 and extends in rotatable fashion through the central passageway 62*b* of mount block 62. Mounted to the inwardly projecting end of mount block 62 is a transmission plate 66 which is positioned rearwardly of block 62 by plate mounting rods 68. The forward ends 68*a* of rods 68 are threaded into block 62 and the transmission plate 66 is affixed to the rearward ends of mounting rods 68 by threaded plate fasteners 68*b*.

Mounted to the inside surface of transmission plate 66 is a gear box 70 which houses a gear train 70*a*. Mounted to the outer surface of the transmission plate 66 is a reversible motor M which is interconnected by its rotary drive shaft to the gear train 70*a*, The drive output shaft of the gear train 70*a* which projects toward the inner end of the hook stem 58*a* is mechanically connected to the hook stem via a removable cylindrical collar 72 with such collar affixed to the end portion of the stem 58*a* by a set screw 72*a* and affixed to the drive output shaft of the gear train by a set screw 72*b*. The reversible motor M is controlled by the game circuitry as will be described hereinafter and provides movement to, and positioning of, the ring hook 58 in accordance with game on-off energization and skill level selection of hook stationary positioning, oscillating motion or complete revolution.

Referring again to FIG. 3 of the drawings, in which the front elevation view of the upright console of the ring-swing game is illustrated, it is to be noted that the game escutcheon wall 28 of the console includes game instruction panels 74. The escutcheon wall also includes player #1 and player #2 play indication buttons 76*a* and 76*b*, respectively, and skill level selection button 78*a* and score reset button 78*b*. The skill level button 78*a* changes the electronic game program so that instead of the simple first level skill of fixed position of ring hook 58 with the hook opening in a vertical upward ring catch orientation, upon depression of such button the hook rotation mechanism 60 is activated so that the hook is rotationally alternated left and right to about 90 degrees of its vertical upward ring catch position for second skill level play by the game player or players. With an additional depression of skill level button 78*a* the electronic game program is changed so that the hook rotation mechanism 60 continuously rotates the hook (and its hook opening) over 360 degrees during the periods within which the player or players attempt to attain ring hooks for third skill level (highest level) play by the game player or players. The score reset button 78*b* may be activated by a player to set the player scores back to zero.

During periods when the ring-swing skill game is idle and not operating in response to coin activation of the game circuitry, the hook rotation mechanism positions the hook 58 in a stationary position with its hook opening facing downwardly whereby ring hooking is precluded. With initiation of game play by coin activation and the depression of play indication button 76*a* (player #1) or buttons 76*a* and 76*b* (for players #1 and #2), the hook rotation mechanism 60 positions the hook 58 in a stationary position with its hook opening facing upwardly for first skill level play by the game player or players.

Referring further to FIG. 3 of the drawings, there is shown mounted to the upper vertical front wall segment 20 of console 10 a player scoring panel and computer circuit board 80 wherein a three numeral light emitting diode (LED) unit 82*a* displays the progressive game score of player #1. A like three numeral LED unit 82*b* displays the progressive game score of player #2 when 2-player game competition is effected by appropriate coin deposits in the game apparatus and 2-player game mode operation is selected via actuation of the 2-player game indication button 76*b*. The three numeral LED unit 82*c* displays the highest prior game score by a player for the swing-ring skill level selected for the single-player or dual-player game mode then in progress. If a current player exceeds the high prior game score as indicated via LED unit 82*c* for the selected game skill level a special game prize may be awarded by the swing-ring skill game proprietor. Single numeral LED units 84*a* located on scoring panel 80 indicate in sequence (left to right) that a player is accumulating bonus scoring points which will, if fully attained during a play period, add to the progressive score of such player. Single numeral LED units 84*b* located on scoring panel 80 indicate the skill level selected for the game under progress.

The lower vertical front wall segment 24 of console 10 includes an upper door 88 which includes an upper set of coin deposit slots 88*a* and 88*b* and a lower set of coin return ports 86*c* and 86*d*. The upper door 86 is security-locked with restricted access only via appropriate key insertion in lock 86*e*. The door 86 leads into compartment 86*f* (see FIG. 1) which includes coin reception and coin rejection apparatus of known design and operation for coin-operated game machines. A lower door 88 in lower wall segment 24, with security lock 88*a*, provides access to a coin storage compartment 88*b*.

The intermediate vertical front wall segment 22 includes an audio speaker 90 whereby musical background and special musical effects are broadcast from the game apparatus to attract game players, during game play, and in response to game hook scoring and bonus point scoring by game players. Located within the upper compartment 28 of game console 10, as shown in dashed outline in FIGS, 1 and 3, is a computer circuit board 80 and power supply 92. Also shown in FIGS. 1 and 3 is a fluorescent lamp 94 which provides desired illumination for the front wall segments 20 and 22 of the game console 10, Referring now to FIG. 6, there is shown a block diagram flow chart of the operation of the ring-swing skill game of the present invention from the point of apparatus "power on" to the "game over" mode. FIG. 7 is a continuation of the flow chart of FIG. 6 and via block diagram presentation such figure shows the scoring modes of the ring-swing skill game and scoring illumination and de-illumination modes thereof. The electronic circuitry employed for controlling the operation of the ring-swing skill game of the invention is centered about the computer circuit board 80 which is preferably a micro-circuitry board which is effective to be programmed for converting analog voltage inputs into the digital control and display information utilized throughout the game apparatus. Thus, the computer board receives direct current power from a standard computer power supply 92 which converts AC current to relatively low voltage (±5 to ±12 volts) direct current for use throughout the game circuitry system.

Figure 6:
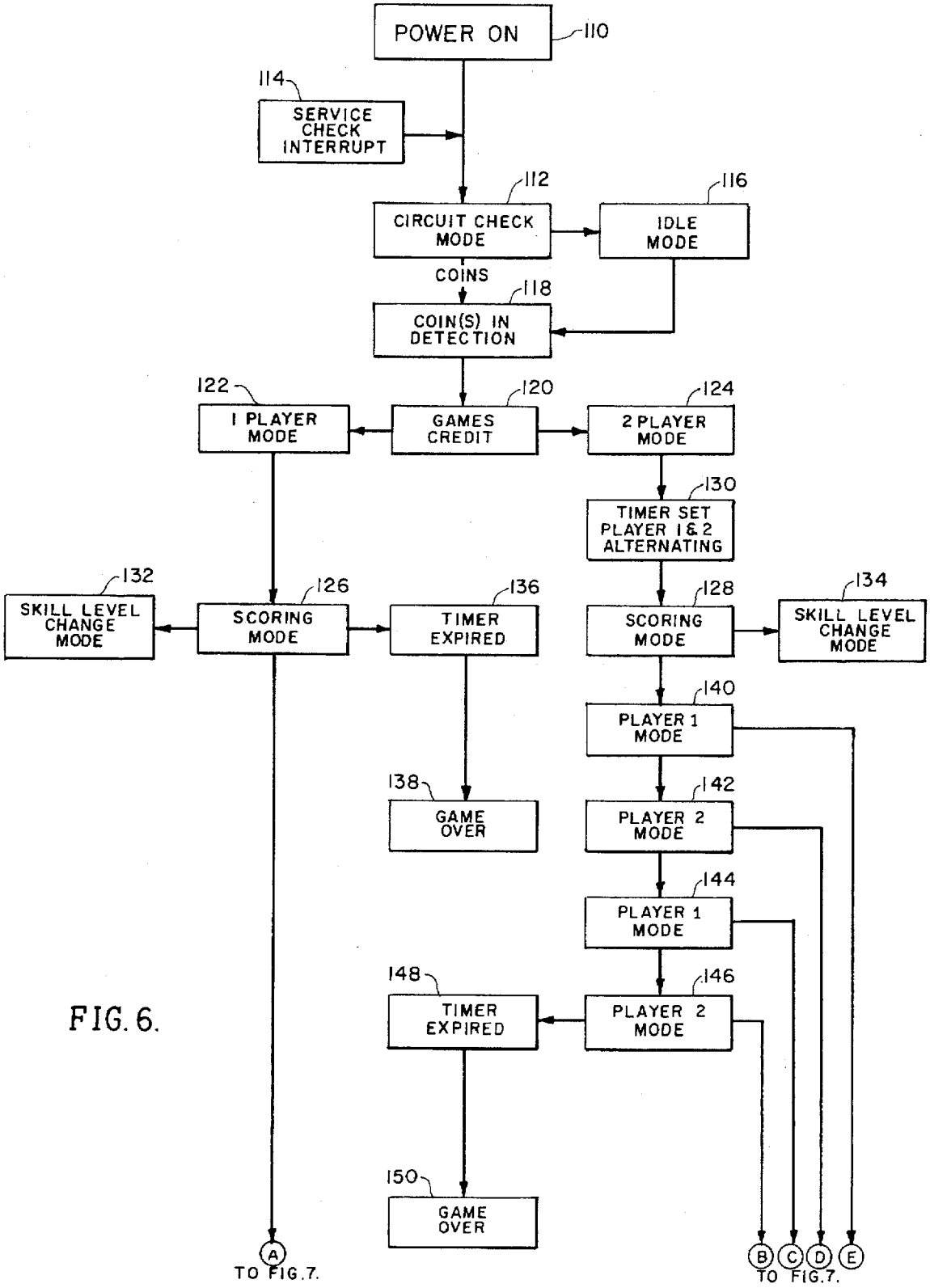
FIG. 6 is a diagrammatic view of the operational flow chart of the ring-swing skill game of the present invention from the "power on" to "game over" modes.
Figure 7:
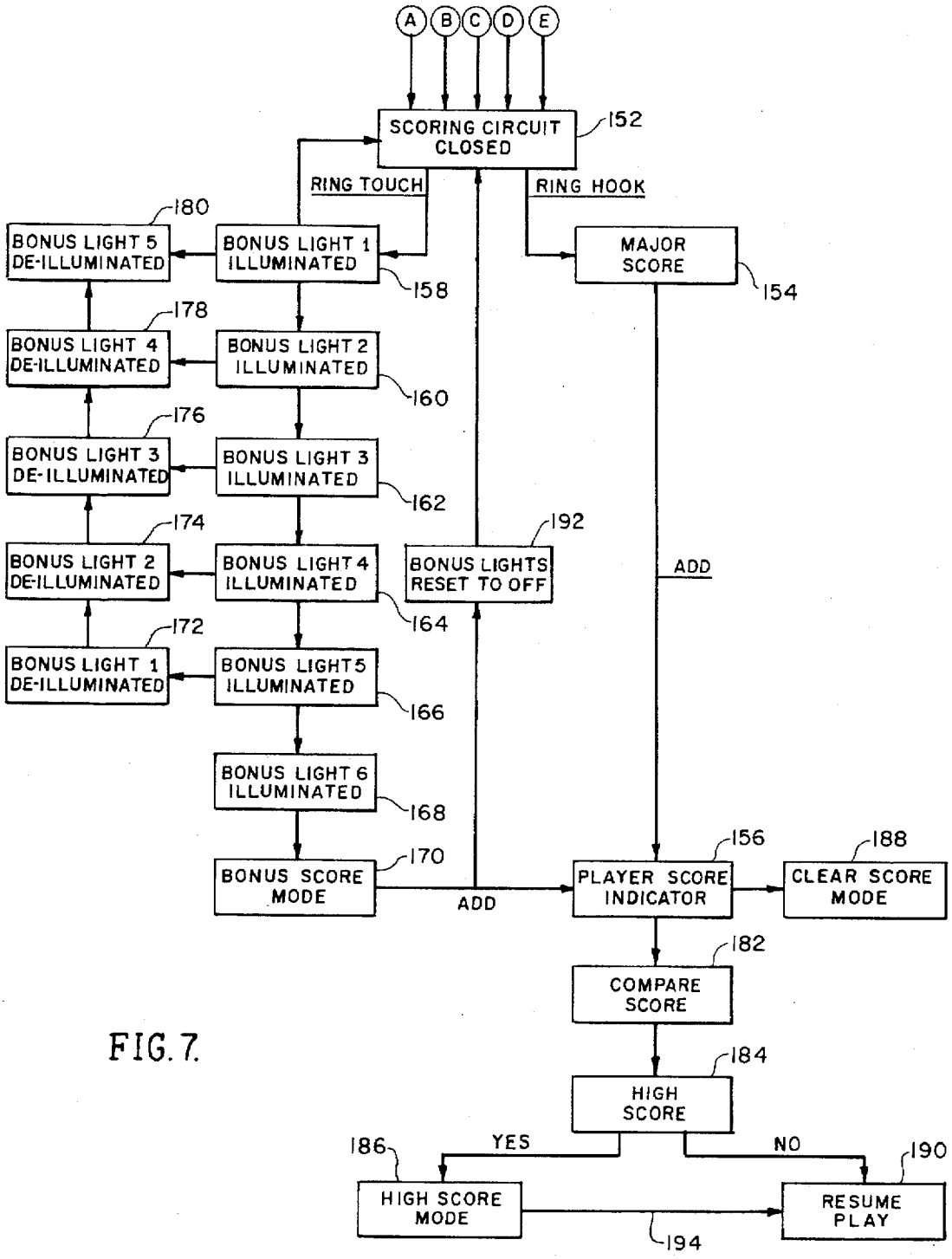
FIG. 7 is a diagrammatic view of the scoring modes of the ring-swing skill game with scoring display illumination and de-illumination modes as a continuation of the operational flow chart of FIG. 6.

Plug-in of the game apparatus to an 110–120 Volt AC power source, and switching on the game, immediately activates the "power on" mode 110 of the circuitry of the apparatus as illustrated in the initial block of the block diagram flow chart of FIG. 6. The computer board immediately places the system in its automatic "circuit check" mode 112 unless such mode is interrupted by a service technician through "service check interrupt" mode 114. A service check is imposed on the game's circuitry system by depression of a normally closed switch button (positioned within the console 10 of the game apparatus) to permit the service technician to check the computer board functions.

Assuming that all of the game's electronic systems and electrically driven game apparatus components are operating properly following the automatic "circuit check" or technician imposed "service check interrupt" modes 112 and 114, respectively, the circuitry system of the game apparatus is placed in its "idle" mode 116 awaiting game initiation by the insertion of coins by one or two players in the coin slots **86*a* and 86*b* of the console 10. During the "idle" mode the LED displays are illuminated and music is played intermittently to attract players and the ring hook is maintained in its downward "out-of-play" position. Also during the "idle" mode 116 the computer board continuously monitors, via the "coin(s) in detection" mode 118, the coin deposit slots 86*a* and 86*b* and directs the coin handling apparatus to accept the inserted coins (if determined to be valid game tender) or reject improper coins to the coin return ports 86*c* or 86*d***.

When an acceptable coin is inserted by a single player into coin deposit slot **86*a* the "games credit" mode 120 of the computer board circuitry is activated and thereafter with single player depression of the player #1 play indication button 76*a* the "1 player" mode 122 of the game circuitry is activated. Upon activation of the "1 player" mode the game ring hook 58 rotates to its upright ring-catch position as shown in FIG. 1 and single player game play commences with, if programmed, the playing of music. If more than one acceptable coin is deposited by the single player games credit is registered by the "games credit" mode 120. With the "1 player" mode 122 activated and the game hook in its upright ring-catch position, the computer board circuitry is set in its "scoring" mode 126 to detect and record ring-to-hook touches and ring catches by the target hook 58** and to accumulate (via numeric accumulation circuitry) and display the player's score through and to the end of game play.

At the commencement of game play the player may depress skill level button **78*a* to activate the "skill level change" mode 132 thereby changing the electronic game program so that instead of the simple first level of game skill (fixed position of ring hook 58 with the hook opening in a vertical upward ring catch orientation) the hook rotation mechanism 60 is directed to alternate rotation of the hook to the left and to the right from its vertical upward ring-catch position from about 45 degrees to about 135 degrees. Thus, a second (more difficult) skill level of game play is established. With an additional depression of skill level button 78*a* the electronic game program is changed so that the hook rotation mechanism 60 continuously rotates the hook 58** over 360 degrees thereby establishing an even more difficult skill level of game play.

With the "1 player" mode 122 of the computer board circuitry in operation, the desired skill level selected by the single player, and the "scoring" mode 126 operational, ring-swing scoring attempts are tried by the player for a programmed period of game play, i.e, a period of 1 minute, 1 and ½ minutes, etc. with the game terminated via "timer expired" mode 136. Upon expiration of the game play period, the "game over" mode 138 is activated and the target hook 58 is returned by the computer board circuitry to its downward "out-of-play" position.

If acceptable coins are deposited by two players into coin deposit slots **86*a* and 86*b* the "games credit" mode 120 of the computer board circuitry is activated and, if followed by depression of the player #2 play indication button 76*b*, the "2 player" mode 124 of the game circuitry is activated and game play begins with the players alternating in periods of ring-swing hook attempts. With the "2 player" mode 124 activated and the game hook 58 rotated to its upright ring-catch position, the computer board circuitry is set in its "scoring" mode 128 to detect and record ring-to-hook touches and ring catches by the target hook and to accumulate and display the respective 2 player scores through and to the end of game play. Also, a "timer set" mode 130 of the computer board circuitry is activated to regulate alternating periods of player ring-swing attempts. Again, player depression of the skill level button 78*a* activates the "skill level change" mode 134** for selection of the skill level for the 2 player game.

With the "2 player" mode 124 of the computer board circuitry in operation, the desired skill level selected by the two players, and the "scoring" mode 128 operational, ring-swing scoring attempts are tried by the players for alternating programmed periods (may be 2 or more periods for each player) of game play, The alternating periods of 2 player ring-swing attempts may be programmed to extend over times of ½ minute, 1 minute or more or less. As shown in FIG. 6 these alternating periods of 2 player game play activity are represented by "player 1" mode 140, "player 2" mode 142, "player 1" mode 144 and "player 2" mode 146 and are terminated via "timer expired" mode 148, Upon expiration of the alternating game play periods, the "game over" mode 150 is activated and the target hook 58 is returned, by computer board circuitry direction of the hook rotation mechanism 60, to its downward "out-of-play" position.

The 1 player "scoring" mode 126 and the 2 player "scoring" mode 128 (through the latter's successive alternating "player 1", "player 2", "player 1" and "player 2" modes 140, 142, 144 and 146, respectively) interface through interconnect computer board circuitry points A, B, C, D and E of FIG. 6 (circled letters) with corresponding circuitry points A, B, C, D and E of FIG. 7 (circled letters) through the "scoring circuit closed" detection mode 152 to the light emitting diode (LED) scoring units 82*a*, 82*b* and 82*c* and the circuitry of the bonus point indication light units 84*a* (see FIG. 3). With the "scoring circuit closed" detection mode 152 set into operation via the 1 player "scoring" mode 126 or the 2 player "scoring" mode 128, the computer circuit board 80 initiates the score detection and score indication circuitry of the board as diagrammatically illustrated in FIG. 7. Thus, ring hooks (ring 54 hooked to hook 58) for a single player or alternatively for two players, are sensed via "major score" mode 154 and are added and displayed through the "player score indicator" mode 156 which is interconnected to player #1 LED score display unit 82*a* or to player #2 LED score display unit 82*b*.

Ring touches (ring 54 contact with hook 58) for a player (during a term or turn of game play) are sensed via the computer board circuitry and are sequentially recorded via six "bonus light illuminated" modes 158, 160, 162, 164, 166 and 168 and indicated in sequence by the interconnected six single numeral bonus score LED units 84*a*. If, during a player's turn of game play, a sequence of six ring touches is achieved within a set time frame, a bonus point score is added (via "bonus score" mode 170) to such player's score with the then total player score shown by score display unit 82*a* or 82*b* through "player score indicator" mode 156. At the end of a successful sequence of six ring touches during a player's turn of game play bonus points are added to the player's score and the sequence of illuminated bonus score LED units 84*c* is de-illuminated via "bonus light de-illuminated" modes 172, 174, 176, 178 and 180. Where less than six of the bonus score LED units 84*a* are illuminated by ring touches at the end of a player's term or turn of game play, the then illuminated units of the bonus score LED units 84*a* are de-illuminated by de-illumination modes 172, 174, 176, 178 and 180 and the player's score is finalized as of the end of the play term or turn with the then score indicated via score display unit 82*a* (player #1) or score display unit 82*b* (player #2). Also, if a successful ring touch is not achieved within a pre-set time from a prior ring touch the "bonus light illuminated" mode last illuminated is de-illuminated. At the end of game play the bonus score light modes are reset to lights (LED units) off via reset mode 192.

During and at the end of a single player game or during and at the end of 2 player game play the player 1 score and/or the player 2 scores are compared via "compare score" mode 182 to the highest prior game score in the memory of the computer board circuitry. If a player's game score is higher then the high score for any prior game (as retained in the computer board memory) the then current player's higher game score is substituted in the computer memory by high score circuitry 184 of the computer board as the high score to be attained (if possible) in current or future game play and such new highest game score is shown via the three numeral LED unit 82*c* (see FIG. 3) as directed by the "high score" mode 186. Current game scores displayed via score display units 82*a* and 82*b* are cleared at the end of game play via "clear score" mode 188. If the current game has not reached the end of its playing time the "resume play" mode 190 (as directed through circuitry interconnect 194 by the "high score" mode 186) maintains game play. The scores displayed via the three numeral LED unit 82*a* or units 82*a* and 82*b* can be reset to zero by depressing the "clear score" mode 188. This reset mode facilitates competition and score keeping when more than 2 players are engaged in game play.

It is to be understood that when pre-programmed events occur before, during and after game play, music, console back lighting, and/or LED display score illumination may be activated to highlight such events. For example, when a new "highest score" is attained by a game player attention-getting music may be played by direction of the computer board circuitry and the high score LED unit 82*c* may flash the new recorded high score.

It is also to be understood that, in accordance with the scope of the invention, other mechanisms for de-activating the ring hook 58, and thereby game play, may include retraction of the hook into the game console and blockage of the hook opening. Further, game play may be precluded by retraction of the swing ring tethering cord 52 or all or a portion of the ring-swing pole or boom 34 and game play may be terminated if there is detected tampering with the ring-swing boom or hook and hook rotation mechanism 60.

As a further embodiment of the present invention, the basic structure of the ring-swing game (console, target hook, projecting boom, elongated flexible member suspended from the boom and ring affixed to the free end of the flexible member for swinging movement toward the console and hook) simplified electrical circuitry and hook rotation means may be provided for rotating the hook from a pre-game position (hook opening in a vertical downward orientation) to a game play position (hook opening in a vertical upward ring catch orientation). After a player's attempt to hook the swing-ring on the target hook the simplified circuitry directs the hook rotation means to rotate the hook from the game play position to the pre-game position. In such embodiment of the invention, the simplified circuitry includes sensing means (responsive to ring-grasp by the player) for activating the hook rotation means to rotate the target hook from its pre-game position to its game play position and delay-timing means (responsive to the release of the swing-ring by the player) for activating the hook rotation means (after an appropriate time interval) to rotate the target hook back to its pre-game position.

Circuitry means may be provided for detecting whether or not a player is freely swinging the game ring in attempts to obtain a ring contact or ring hook or merely grasping the ring or tether cord and touching the ring to the hook or hooking the ring to the hook without the passage of appropriate ring swing time. Such circuitry detection means may include motion detector means or registration by the circuitry of circuitry changes including, but not limited to, changes in circuitry capacitance.

Although the present invention has been fully described by way of preferred embodiments thereof with reference (where appropriate) to the accompanying drawings, various additions, changes and modifications will be apparent to those having skill in the field. For example, the ring-swing game of the invention may be designed to include multiple ring hooks and the configuration and size of the game console may be significantly altered. The game apparatus may be coin-operated or solely by player button actuation. Further, award ticket dispensing means may be associated with the game apparatus and operated by pre-programming of the computer board whereby special high score prizes, progressive jackpots and further game play may be made available to the game players. Therefore, unless otherwise these changes and modifications depart from the scope of the present invention, they should be construed as included therein.

What we claim is:

1. In a ring-swing skill game for one or more players comprising an upright game console having a front game play side, a rotatable target hook projecting from the front game play side of said console, a boom projecting forwardly from the upper portion of the front game play side of said console, an elongated flexible member suspended from the outer free end of said boom, and a ring affixed to the lower free end of said flexible member for swinging movement toward said game console by one or more players during game play to attain hooking engagement of said ring with said target hook, the improvement comprising:

a) an electrically powered programmable computer board including electronic game scoring circuitry located within said console and electrically interconnected to said ring through said boom and said flexible member and said hook for detecting and recording ring contacts with, and ring catches by, said hook as scoring events during ring-swing game play;

b) electronic game score display means located on the front game play side of said console and interconnected to said computer board for indicating numeric score values to said one or more players during game play; and c) means electrically interconnected to said computer board for rotating said hook from a pre-game position with the hook opening of said hook in a fixed vertical downward orientation to a first skill level position during game play with said hook opening in a fixed vertical upward ring catch orientation.

2. The ring-swing skill game for one or more players as claimed in claim 1 wherein a skill level switch is electrically interconnected to said computer board and to said means for rotating said hook whereby upon first actuation of said switch said hook is rotationally oscillated alternately left and right for up to about 135 degrees of its vertical upward ring catch orientation as a second skill level during game play.

3. The ring-swing skill game for one or more players as claimed in claim 2 wherein upon second actuation of said skill level switch said means for rotating said hook rotates said hook continuously over 360 degrees as a third skill level during game play.

4. The ring-swing skill game for one or more players as claimed in claim 1 wherein said game is for play by one or two players and first player and second player indication switches are electrically interconnected to said computer board whereby upon actuation of said first player indication switch programmed game play is limited to one player and upon actuation of said second player indication switch programmed game play accommodates two players.

5. The ring-swing skill game for one or more players as claimed in claim 1 wherein said computer board includes electronic game timing circuitry whereby game play time for said one or more players is limited to one or more programmed periods of time.

6. The ring-swing skill game for one or more players as claimed in claim 1 wherein means for coin reception, coin acceptance or rejection, rejected coin return, and accepted coin storage are provided and electrically interconnected to said computer board to initiate game play based upon the computer board recognition of the reception of an appropriate number of acceptable coins.

7. In a ring-swing skill game for one or two players comprising an upright game console having a front game play side, a rotatable target hook projecting from the front game play side of said console, an elongated boom projecting forwardly from the upper portion of said console, an elongated flexible member suspended from the outer free end of said boom, and a ring affixed to the lower free end of said said flexible member for swinging movement toward said game console by one or two players during game play to attain hooking engagement of said ring with said target hook, the improvement comprising:

a) an electrically powered programmable computer board including game scoring circuitry means and progressive score accumulating means, said computer board located within said console and electrically interconnected to said ring through said boom and said flexible member and said hook for detecting and recording ring contacts with, and ring catches by, said hook as scoring events during ring-swing game play and for accumulating the progressive scores of said one or two players;

b) electronic game score light emitting diode display means located on the front game play side of said console and interconnected to said computer board for indicating accumulated numeric score values to said one or two players during game play; and c) hook rotating means electrically interconnected to said computer board for rotating said hook from a pre-game position with the hook opening of said hook in a fixed vertical downward orientation to a first skill level position during game play with said hook opening in a fixed vertical upward ring catch orientation and for rotating said hook to said pre-game position upon conclusion of game play.

8. The ring-swing skill game for one or two players as claimed in claim 7 wherein a skill level switch is electrically interconnected to said computer board and to said hook rotating means whereby upon first actuation of said switch after game initiation said hook is rotationally oscillated alternately left and right for up to about 135 degrees of its vertical upward ring catch orientation by said hook rotating means as a second skill level during game play and for rotating said hook to its pre-game position upon conclusion of the game.

9. The ring-swing skill game for one or two players as claimed in claim 8 whereby upon second actuation of said skill level switch after game initiation said hook is rotated by said hook rotating means continuously over 360 degrees as a third skill level during game play and said hook is rotated to its pre-game position upon conclusion of the game.

10. The ring-swing skill game for one or two players as claimed in claim 7 wherein first player and second player indication switches are electrically interconnected to said computer board whereby upon actuation of said first player indication switch programmed game play is limited to one player over a single set period of game play and upon actuation of said second player indication switch programmed game play accommodates two players over alternating periods of game play.

11. The ring-swing skill game for one or two players as claimed in claim 7 wherein said computer board includes electronic game timing circuitry whereby game play time for one player is limited to a single programmed period and game play time for two players is limited to programmed alternating periods of game play time.

12. The ring-swing skill game for one or two players a claimed in claim 7 wherein means for coin reception, coin acceptance or rejection, rejected coin return, and accepted coin storage are provided and electrically interconnected to said computer board to initiate game play based upon the computer board recognition of the reception of an appropriate number of acceptable coins.

13. In a coin-operated ring-swing skill game for one or more players comprising an upright game console having a front game play side, at least one rotatable target hook projecting from the front game play side of said console, an elongated boom projecting from the upper portion of the front game play side of said console, an elongated flexible member suspended from the outer free end of said boom, and a ring affixed to the lower end of said flexible member for swinging movement toward said game console by one or more players during game play to attain hooking engagement of said ring with said at least one target hook, the improvement comprising:

a) an electrically powered programmable computer board mounted within said console, said computer board including scoring circuitry means and progressive score accumulating means for said one or more players, said computer board being electrically interconnected to said ring via said flexible member and to said at least one hook for detecting and recording ring contacts with, and ring catches by, said at least one hook as scoring events by said one or more players during ring-swing game play and for accumulating the progressive scores of said one or more players;

b) electronic game score light emitting diode display means located on the front game play side of said console and interconnected to said computer board for indicating accumulated numeric score values attained by each of said one or more players during game play;

c) electronic light emitting diode display means located on the front game play side of said console and interconnected to said computer board for indicating the highest previous game score attained by an individual player as recorded in the memory of said computer board;

d) hook rotation means electrically interconnected to said computer board for rotating said at least one target hook from a pre-game position with the hook opening in fixed vertical downward orientation to a first skill level position during game play with the hook opening in fixed vertical upward ring catch orientation and for rotating said at least one target hook to said pre-game position upon conclusion of game play; and e) means associated with said console for coin reception, coin acceptance or rejection, rejected coin return, and accepted coin storage with said means electrically interconnected to said computer board to initiate game play based upon the recognition by said computer board of the acceptance of said means of an appropriate number of acceptable coins.

14. The coin-operated ring-swing skill game for one or more players as claimed in claim 13 wherein said computer board includes signal storage means for the storage of digital musical information and means for converting said digital information to analog audible musical information for broadcast as attention-getting music through a speaker mounted within said game console, said audible musical information being broadcast upon the occurrence of the happening of pre-programmed game events as detected by said computer board.

15. The coin-operated ring-swing skill game for one on more players as claimed in claim 13 wherein said computer board is programmed to run a circuit check mode and said circuit board further includes means for: checking the player indication buttons, skill level selection buttons and score reset button of the game circuitry; and monitoring the means for coin reception and coin acceptance or rejection and crediting the appropriate number of games to be played corresponding to the number of accepted coins.

16. The coin-operated ring-swing skill game for one or more players as claimed in claim 13 wherein award ticket dispensing means is associated with said game console and operated by said computer board in response to pre-programmed game score achievements to generate award tickets for high score prizes, progressive jackpot awards and credits for further game time.

17. The coin-operated ring-swing skill game for one or more players as claimed in claim 13 wherein said elongated flexible member includes electrical conductive means whereby an electrical circuit is completed between said ring, said hook and said computer board upon ring contact with, and ring catches by, said hook as scoring events during ring-swing game play.

18. The coin-operated ring-swing skill game for one or more players as claimed in claim 13 wherein means are provided to effect: target hook rotation to a non-play position, target hook retraction to a non-play position, closure of the target hook opening to preclude ring hooks, retraction of said elongated boom to a non-play position, and/or retraction of said flexible member to preclude game play, in the event of: player interference with or operational failure of said hook, boom or flexible member, rejection of an unacceptable coin, or the conclusion of game play.

19. In a ring-swing skill game comprising an upright game console having a front game play side, a rotatable target hook projecting from the front game play side of said console, a boom projecting forwardly from the upper portion of the front game play side of said console, an elongated flexible member suspended from the outer end of said boom, and a ring affixed to the lower end of said flexible member for swinging movement thereof by a game player toward said console in an attempt to attain hooking engagement of said ring with said hook, the improvement comprising:

a) means for rotating said hook from a pre-game position with the opening of said hook positioned in a vertical downward orientation to a game play position with the opening of said hook positioned in a vertical upward ring catch orientation, said means for rotating said hook from said pre-game position to said game play position being activated by sensing means responsive to ring-grasp by a game player; and b) means for rotating said hook from said game play position to said pre-game position following game play attempts by said player to attain hooking engagement of said ring with said hook, said means for rotating said hook from said game play position to said pre-game position being activated by delay timing means responsive to the release of said ring by said player and swinging movement thereof toward said console.

* * * * *